US007543802B2

(12) United States Patent
Petta et al.

(10) Patent No.: US 7,543,802 B2
(45) Date of Patent: Jun. 9, 2009

(54) RAILING SYSTEM

(75) Inventors: Gabriel Petta, Woodbridge (CA); Rolf J. Ohrstrom, Toronto (CA)

(73) Assignee: Alpa Lumber Inc., Mississauga (CA)

( * ) Notice: Subject to any disclaimer, the term of this patent is extended or adjusted under 35 U.S.C. 154(b) by 0 days.

(21) Appl. No.: 11/742,826

(22) Filed: May 1, 2007

(65) Prior Publication Data

US 2008/0054242 A1 Mar. 6, 2008

Related U.S. Application Data

(60) Provisional application No. 60/824,544, filed on Sep. 5, 2006.

(51) Int. Cl.
*E04H 17/00* (2006.01)

(52) U.S. Cl. ..... 256/65.08; 256/59; 256/65.03

(58) Field of Classification Search ..... 256/19, 256/21, 22, 59, 65.02, 65.03, 65.08
See application file for complete search history.

(56) References Cited

U.S. PATENT DOCUMENTS

| | | | | |
|---|---|---|---|---|
| 3,756,567 | A * | 9/1973 | Murdock | 256/21 |
| 4,220,316 | A * | 9/1980 | Naka et al. | 256/59 |
| 4,334,671 | A * | 6/1982 | De Guise | 256/65.12 |
| 4,451,025 | A * | 5/1984 | Spera | 256/65.12 |
| 4,805,879 | A * | 2/1989 | Spera | 256/65.12 |
| 4,809,955 | A | 3/1989 | Veilleux | |
| 6,152,428 | A * | 11/2000 | Simioni | 256/19 |
| 6,702,259 | B2 | 3/2004 | Pratt | |
| 6,874,766 | B2 | 4/2005 | Curatolo | |

FOREIGN PATENT DOCUMENTS

| | | |
|---|---|---|
| CA | 2403173 | 3/2004 |

OTHER PUBLICATIONS

Installation Instructions. Royal Crown Limited. 4" SS Surface Post Mount Installation Instructions. p. 1-IN005.
Installation Instructions. Royal Crown Limited. 4" Newel Post Installation Instructions. p. 1-IN003.
Product Information. Royal Building Products. Architectural Series. pp. 1-2.
Installation Instructions. Royal Crown Limited: Brock Deck Systems. Deck & Railing Installation Instructions. pp. 1-27.

* cited by examiner

*Primary Examiner*—Michael P Ferguson
(74) *Attorney, Agent, or Firm*—Bereskin & Parr

(57) ABSTRACT

A rail for a railing system includes a proximal member extending lengthwise of the rail and securable to ends of balusters; a cover member extending lengthwise of the rail and disposed adjacent the proximal member; and a reinforcement member disposed between the proximal member and the cover member. The reinforcement member includes a first attachment element coupled to a first one of the proximal and cover members, and the other one of the proximal and cover members is coupled to at least one of the reinforcement member and the first one of the proximal and cover members.

14 Claims, 10 Drawing Sheets

RAILING SYSTEM

This application claims the benefit of Provisional Application No. 60/824,544, filed Sep. 5, 2006, which is incorporated herein by reference.

FIELD

The Applicant's teaching disclosed herein relates to railing systems that can be used with, for example, porches and stairways, and to components of such railing systems.

BACKGROUND

U.S. Pat. No. 6,702,259 (Pratt) discloses a guard rail system fabricated from standard-sized components, preferably extruded, including balusters fastened to a lower rail and to an upper retainer at fixed intervals. The balusters are provided with central bores for receiving fasteners such as screws through predrilled holes in the upper retainer and lower rail. A hand rail is slip-fitted over the upper retainer in locking relation, to provide integrated guard rail sections. Guard rail sections so assembled are fastened to end posts, preferably using mounting brackets having a flanged arm which nests in grooves or recesses in the upper retainer and lower rail to provide a safe, secure and aesthetically appealing guard rail.

U.S. Pat. No. 6,874,766 (Curatolo) discloses a deck railing section comprising synthetic posts held spaced from one another by top and bottom rail members. Each of the rail members has a multiple piece construction including first and second interlocking synthetic rail pieces and a metallic reinforcing insert. The insert has holes at post attachment locations along the insert. Each post has screw ports to opposite ends of the post. Rail members are secured to the posts by threaded attachment members passing through the holes in the inserts and into the screw ports of the posts. The first rail pieces are trapped between the posts and the inserts. The second rail pieces lock onto the first rail pieces hiding the reinforcing inserts internally of the rail members.

SUMMARY

The following summary is intended to introduce the reader to the disclosure provided herein but not to define any invention. In general, this disclosure describes one or more methods or apparatuses related to railing systems and components thereof, and which can be used with, for example porches and stairways of homes or other buildings.

According to one aspect, a rail for a railing system comprises a proximal member extending lengthwise of the rail and securable to ends of balusters; a cover member extending lengthwise of the rail and disposed adjacent to the proximal member; and a reinforcement member disposed between the proximal member and the cover member. The reinforcement member comprises a first attachment element coupled to a first one of the proximal and cover members, and the other one of the proximal and cover members is coupled to at least one of the reinforcement member and the first one of the proximal and cover members.

In some embodiments, the first attachment element can be coupled to the proximal member. The first attachment element and the reinforcement member can be of integral, unitary construction. The proximal member can comprise a first coupling for engaging the first attachment element. The first attachment element can comprise a pair of first lugs, each first lug protruding laterally outwardly of the reinforcement member. The first coupling element can comprise a pair of first arms, each first arm including a laterally inwardly directed barb. Each first arm can be generally of single wall construction.

In some embodiments, the cover member can be coupled to the reinforcement member. The reinforcement member can comprise a second attachment element coupled to the cover member. The second attachment element and the reinforcement member can be of integral, unitary construction. The cover member can comprise a second coupling for engaging the second attachment element. The second attachment can comprise a pair of second lugs, each second lug protruding laterally outwardly of the reinforcement member. The second coupling element can comprise a pair of second arms, each second arm including a laterally inwardly directed barb.

In some embodiments, the cover member can be coupled to the proximal member. The proximal member can comprise a second attachment element. The cover member can comprise a second coupling for engaging the second attachment element.

According to another aspect, a railing system comprises a plurality of balusters, each baluster having an upper end and a lower end; and an upper rail mounted to the upper ends of the balusters. The upper rail comprises a proximal member secured to the upper ends of the balusters, a reinforcement member having a first attachment element coupled to the proximal member, and a cover member coupled to at least one of the reinforcement member and the proximal member.

In some embodiments, the proximal member can comprise a first coupling for inter-engaging with the first attachment element. The first attachment element can extend generally along the entire length of the reinforcement member. The first attachment element and the reinforcement member can be of unitary construction. The railing system can comprise fasteners each having a threaded shank and a head at one end thereof, the head bearing against the proximal member opposite the balusters, and the threaded shank extending through the proximal member and into the balusters. Each head can be disposed between the reinforcement member and the proximal member. The railing system can further comprise an upright to which an end of the reinforcement can be attached. The upright can comprise a newel post. The railing system can comprise a bracket having a first flange securable to the reinforcement member and a second flange securable to the newel post. The newel post can comprise an extruded body having an outer surface for supporting the second flange of the bracket, the bracket having an aperture for receiving a fastener therethrough, and the outer surface of the newel post comprising an integrally moulded score line aligned with the aperture of the bracket.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
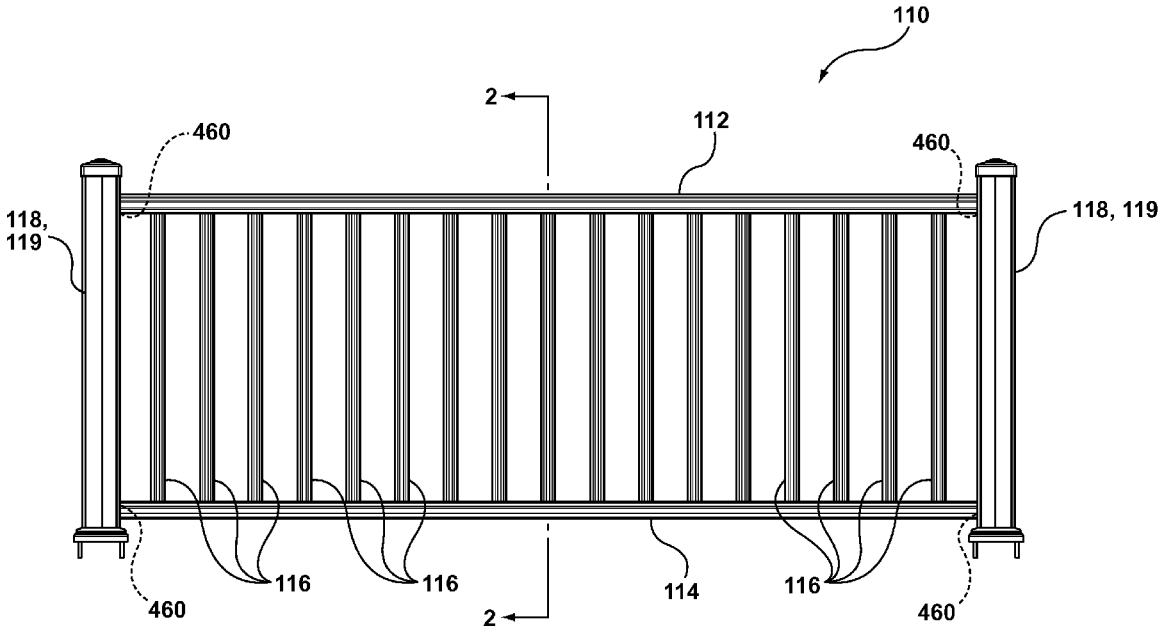
FIG. 1 is a front elevation view of a railing system according to one aspect of the Applicant's teaching.

A railing system 110 in accordance with an example of one aspect of the Applicant's teaching can be seen in FIG. 1. The railing system 110 comprises an upper rail 112, a lower rail 114, and a plurality of balusters 116 each extending generally vertically between the upper and lower rails 112, 114. In the example illustrated, the railing system is shown in a horizontal configuration, with horizontal upper and lower rails 112, 114. The railing system 110 can also be configured for inclined applications, such as along a staircase, with inclined rails 112,114 and vertical balusters 116.

Each of the upper and lower rails 112, 114 are generally elongate, having opposed ends adapted to be secured to uprights 118. The uprights 118 can be in the form of, for example, but not limited to, walls, columns, or posts. In the example illustrated, the uprights 118 are in the form of newel posts 119.

Figure 2:
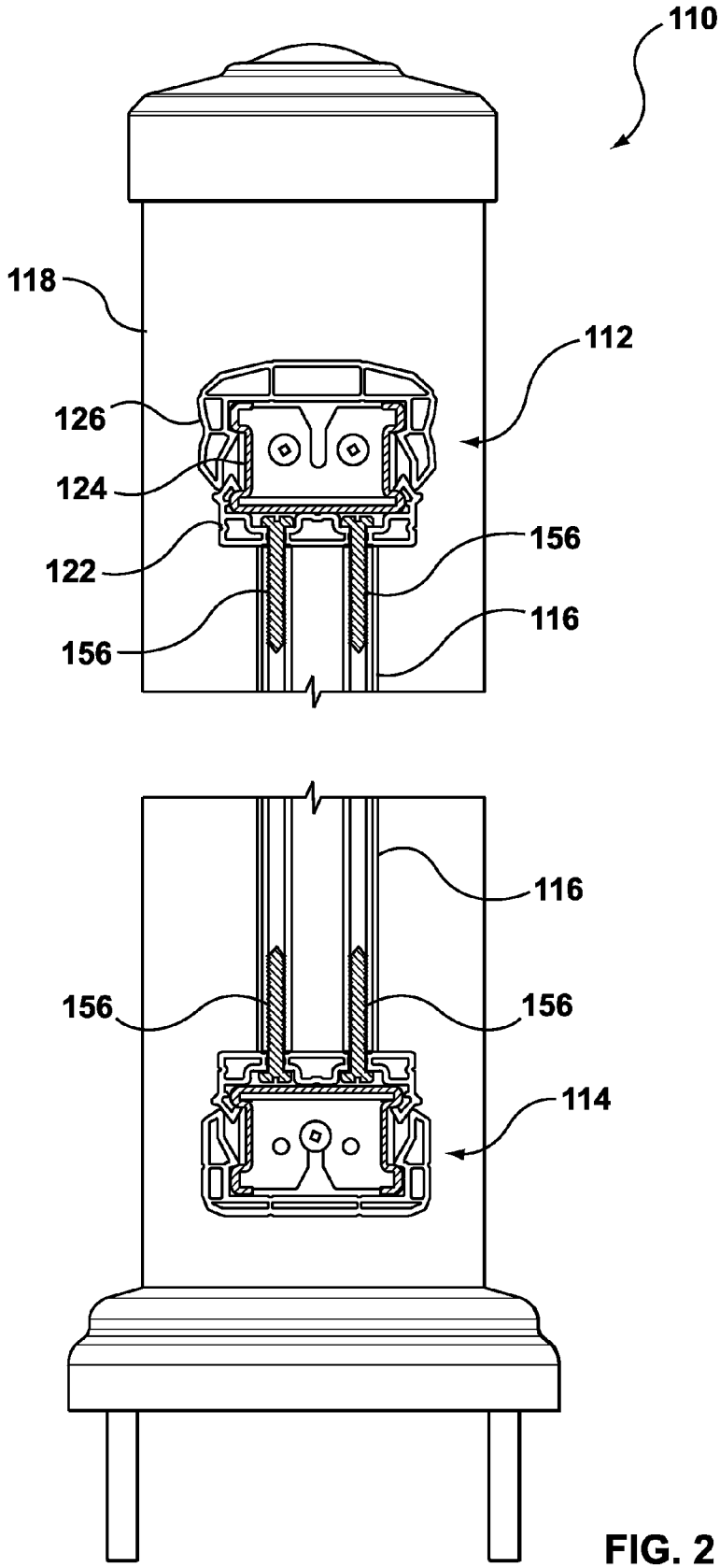
FIG. 2 is a cross-sectional view of the railing system of FIG. 1 taken along the lines 2-2.
Figure 3:
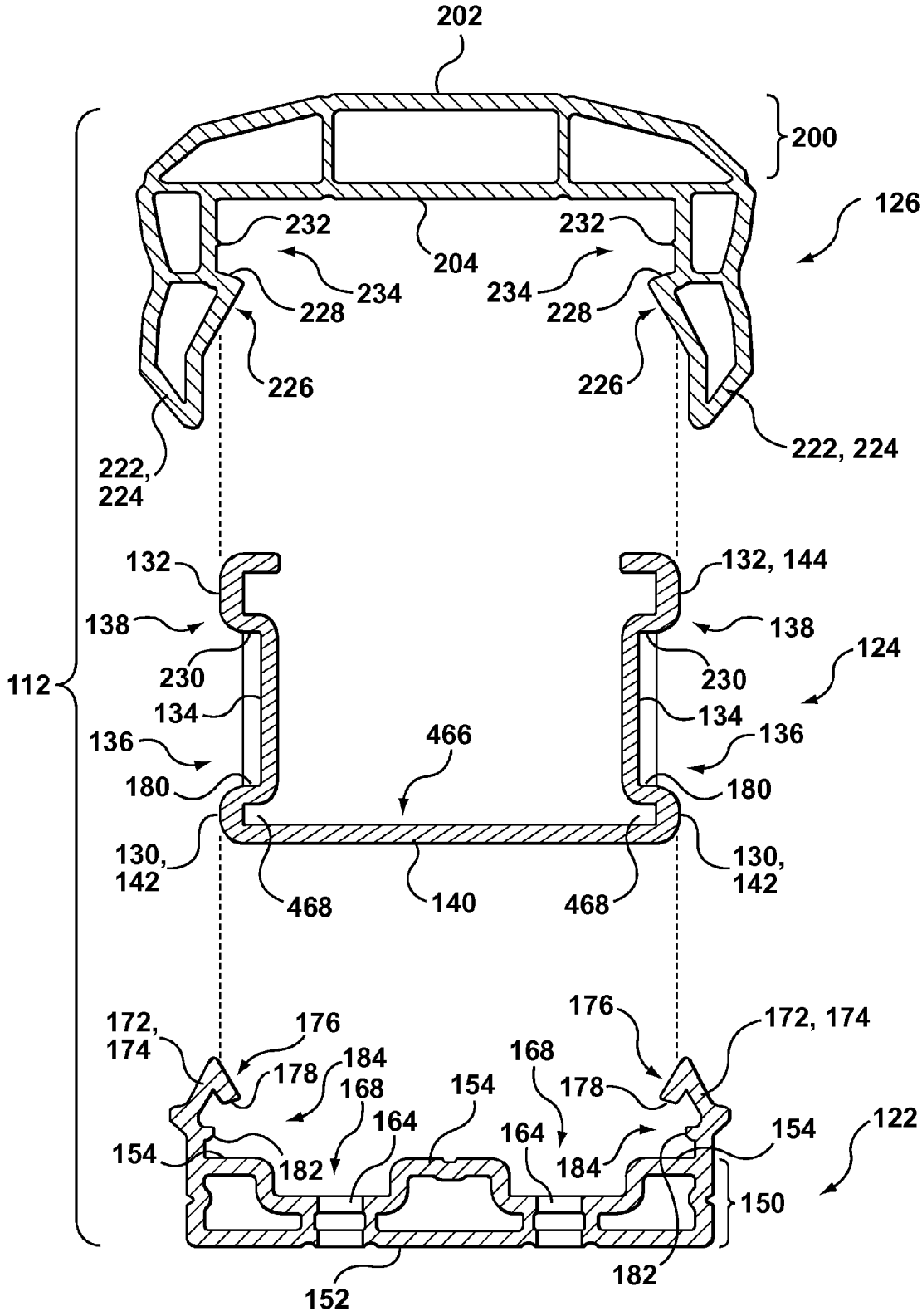
FIG. 3 is an enlarged exploded view of an upper portion of the railing system of FIG. 2.

Referring now to FIGS. 2 and 3, the upper rail 112 comprises a proximal member 122, a reinforcement member 124, and a cover member 126, each extending generally along the length of the upper rail 112. The proximal member 122 is securable to the upper ends of the balusters 116.

In the example illustrated, the cover member 126 is disposed in generally facing relation to the proximal member 122, and the reinforcing member 124 is disposed between the proximal and cover members 122,126. A first and a second connection means can be provided to secure together the members 122, 124, and 126. The first connection means can couple together the reinforcing member 124 with a first one of the proximal or cover members 122,126. The second connection means can couple together the other (second) one of proximal or cover members 122, 126 with either the first one of the proximal or cover members or with the reinforcement member 124 or with both the reinforcement member 124 and the first one of the proximal or cover members 122,126.

In the example illustrated, the first connection means is adapted to couple together the reinforcing member 124 with the proximal member 122, and the second connection means is adapted to couple together the cover member 126 with the reinforcement member 124.

As best seen in FIG. 3, the reinforcement member 124 is, in the example illustrated, provided with first attachment elements 130 for securing together the reinforcement member 124 and the proximal member 122. The reinforcement member 124 can have second attachment elements 132 for securing together the reinforcement member 124 and the cover member 126. Either one or both of the first and second attachment elements 130, 132 can be unitary with the reinforcement member 124.

In the example illustrated, the reinforcement member 124 comprises a pair of sidewalls 134 that are disposed generally in a vertical orientation, between the proximal member 122 and the cover member 126, when viewing the rail 112 in cross-section (FIG. 3). Each sidewall 134 has a proximal edge 136 adjacent the proximal member 122, and a distal edge 138 adjacent the cover member 126. A transverse web 140 can join together the opposed sidewalls. The transverse web 140 can extend generally between the sidewalls 134, adjacent the proximal edges 136 of the sidewalls 134.

In the example illustrated, the first attachment element 130 comprises a pair of first lugs 142, each of the first lugs 142 projecting laterally outwardly from a respective sidewall 134, and adjacent the proximal edge 136 thereof. In the example illustrated, the second attachment element 132 comprises a pair of second lugs 144, each of the second lugs 144 projecting laterally outwardly from a respective sidewall 134, and adjacent the distal edge 138 thereof. The reinforcement member 124 can be constructed of a strong, tough material. In the example illustrated, the reinforcement member 124 is a roll-formed profile of about 14-gauge structural steel, and can be galvanized.

Figure 4:
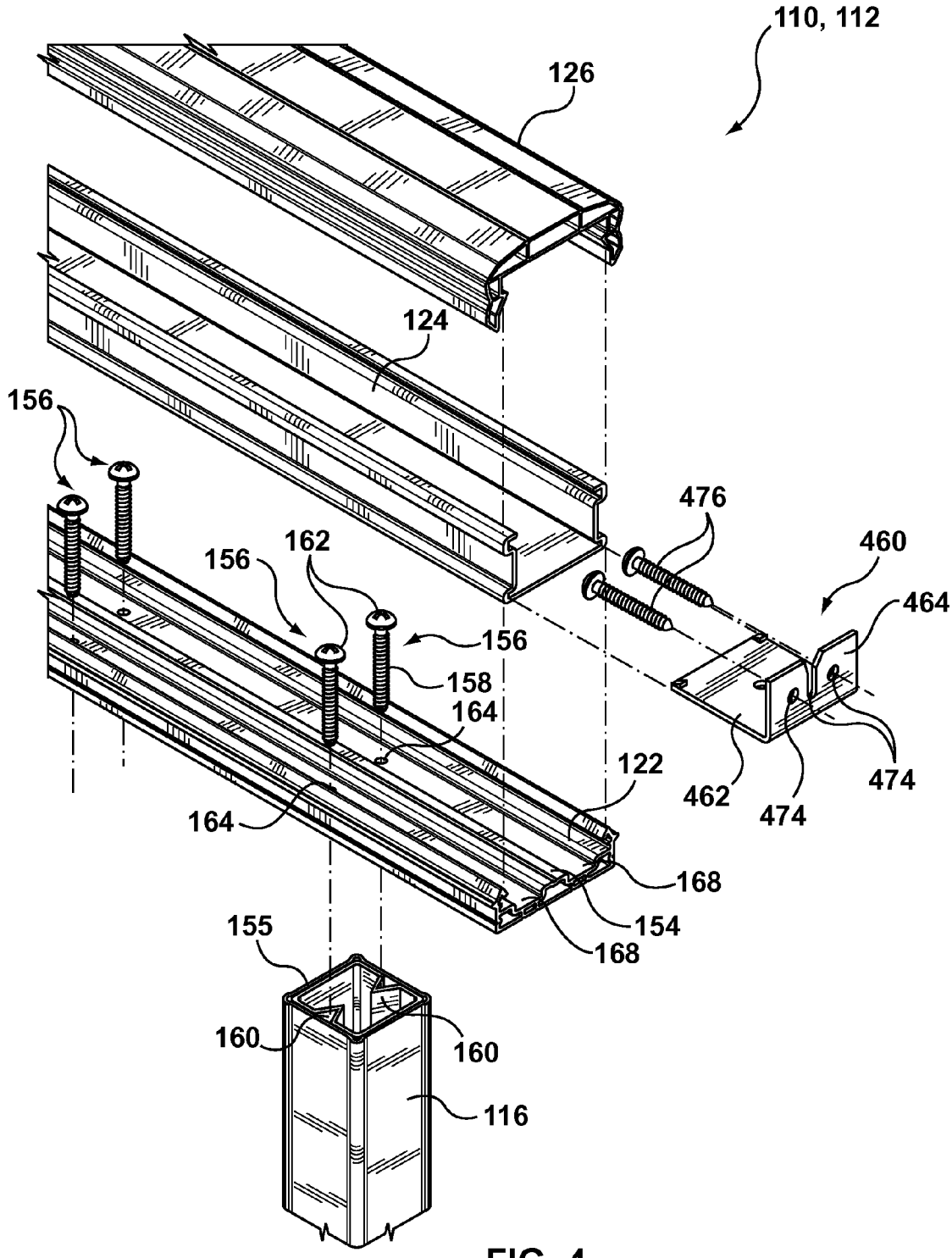
FIG. 4 is an exploded perspective view of an upper portion of the railing system of FIG. 2.

With reference to FIGS. 3 and 4, the proximal member 122 can comprise a base 150 having an outer surface 152 directed towards the ends of the balusters 116 of the assembled railing system 110, and an inner surface 154 directed towards the reinforcement member 124. At mounting locations where the balusters 116 meet the rail 112, at least a portion of the outer surface 152 of the base 122 can bear against the end face 155 (FIG. 4) of the respective balusters 116. The proximal member 122 can be secured to the balusters 116 by passing fasteners 156 through the base 150 and into the balusters 116. In the example illustrated, the fasteners 156 comprise screws having threaded shanks 158 engaged within screw bosses 160 provided in the balusters 116, and heads 162 that bear against the inner surface 154 of the base 150. The base 150 can be provided with apertures 164 for registration with the screw bosses 160 to receive the shanks 158 therethrough. The upper surface 154 of the base 150 can be provided with depressions 168 for receiving the heads 162 of the fasteners 156 in a countersunk manner.

Referring again to FIG. 3, the proximal member 122 can further comprise a first coupling element 172 for inter-engaging with the first attachment element 130 of the reinforcement member 124. In the example illustrated, the first coupling element 172 comprises a pair of first arms 174, the first arms 174 spaced laterally apart from each other to receive the first lugs 142 between the first arms 174. Each of the first arms 174 is, in the example illustrated, directed generally vertically towards the reinforcement member 124, and comprises a laterally inwardly directed barb 176. Each barb 176 has an underside surface 178 spaced vertically apart from the inner surface 154 of the base 150, and configured to bear against a distal surface 180 of a respective one of the first lugs 142. The opposing underside surface 178 of the barb and inner surface 154 of the base 150, and an inner surface 182 of the arm 174 disposed therebetween and laterally offset therefrom defines a recess 184 for receiving a respective one of the lugs 142 in the assembled rail 112.

The proximal member 122 can be constructed of plastic, and, in the example illustrated, comprises an extruded vinyl lineal. The base 150 and first arms 174 are, in the example illustrated, integral with each other. The proximal member 122 can be cut to length after extrusion. The optional holes 164 can be provided using, for example, a jig and drill press to facilitate locating the balusters 116 at a desired position and spacing along the length of the proximal member 122 when securing the balusters 116 to the proximal member 122.

Referring again to FIGS. 3 and 4, the cover member 126 is, in the example illustrated, secured over the reinforcing member 124, in a vertically inverted orientation relative to the proximal member 122. The cover member 126 can be similar in structure to the proximal member 122. Like features of the cover member 126 (compared to the proximal member 122) are identified by like reference characters, incremented by 50.

In the example illustrated, the cover member 126 comprises a base 200 having an outer surface 202 directed away from the reinforcement member 124, and an inner surface 204 directed towards the reinforcement member 124. The outer surface 202 can have a convex shape (when viewed in cross-section) to provide a comfortable surface when the upper rail 112 is grasped by the hand of a user.

The cover member 126 can further comprise a second coupling element 222 for inter-engaging with the second attachment element 132 of the reinforcement member 124. In the example illustrated, the second coupling element 222 comprises a pair of second arms 224, the second arms 224 spaced laterally apart from each other to receive the second lugs 144 of the second attachment element 132 of the reinforcement member 124 between the second arms 224.

Each of the second arms 224 is, in the example illustrated, directed generally vertically towards the reinforcement member 124, and comprises a laterally inwardly directed second barb 226. Each second barb 226 has an underside surface 228 spaced vertically apart from the inner surface 204 of the base 200, and configured to bear against a distal surface 230 of a respective one of the second lugs 144. The opposing underside surface 228 of the second barb 226 and inner surface 204 of the second base 200, and an inner surface 232 of the arm 224 disposed therebetween and laterally offset therefrom defines a second recess 234 for receiving a respective one of the second lugs 144 in the assembled upper rail 112.

Figure 5:
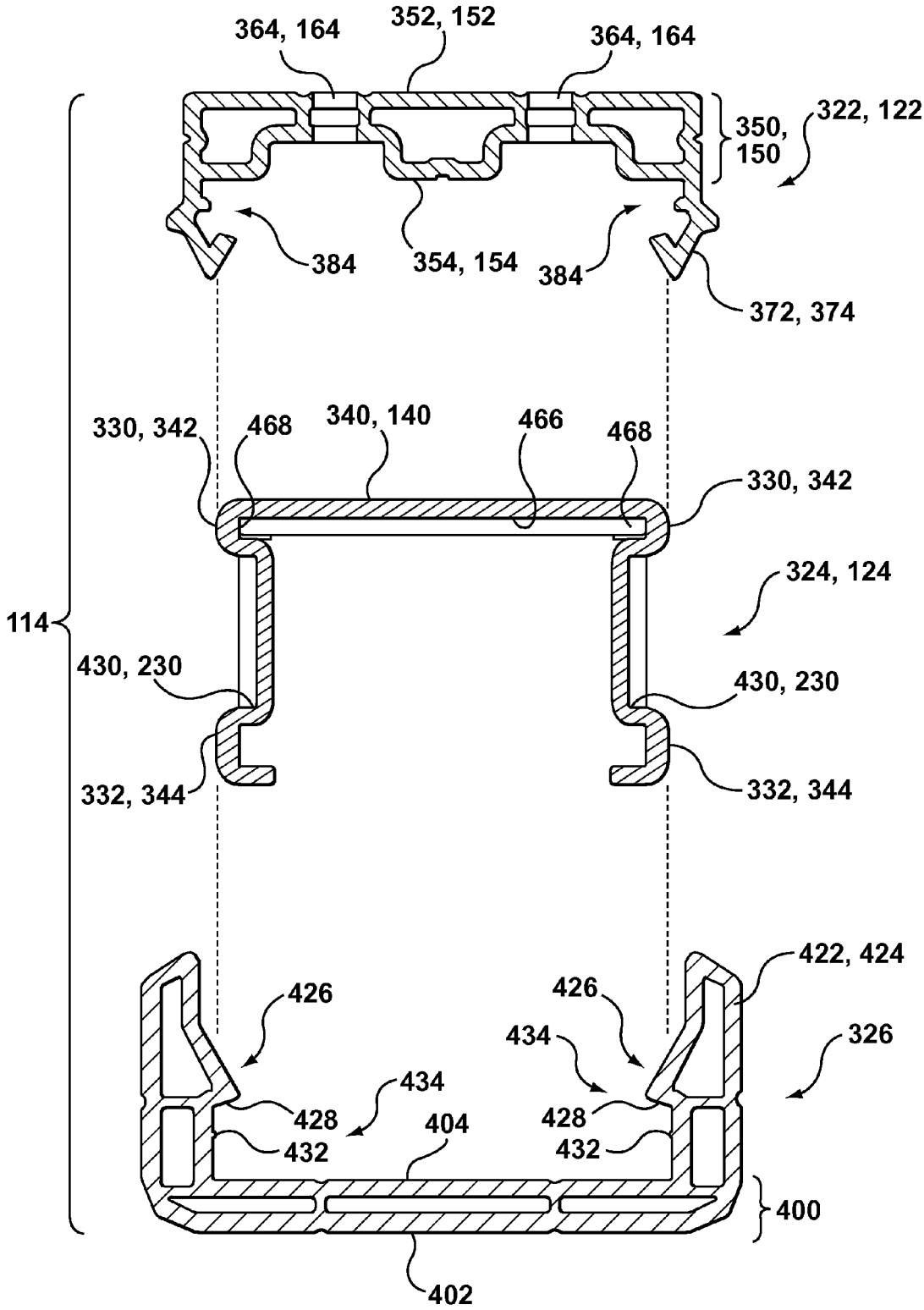
FIG. 5 is an enlarged exploded view of a lower portion of the railing system of FIG. 2.
Figure 6:
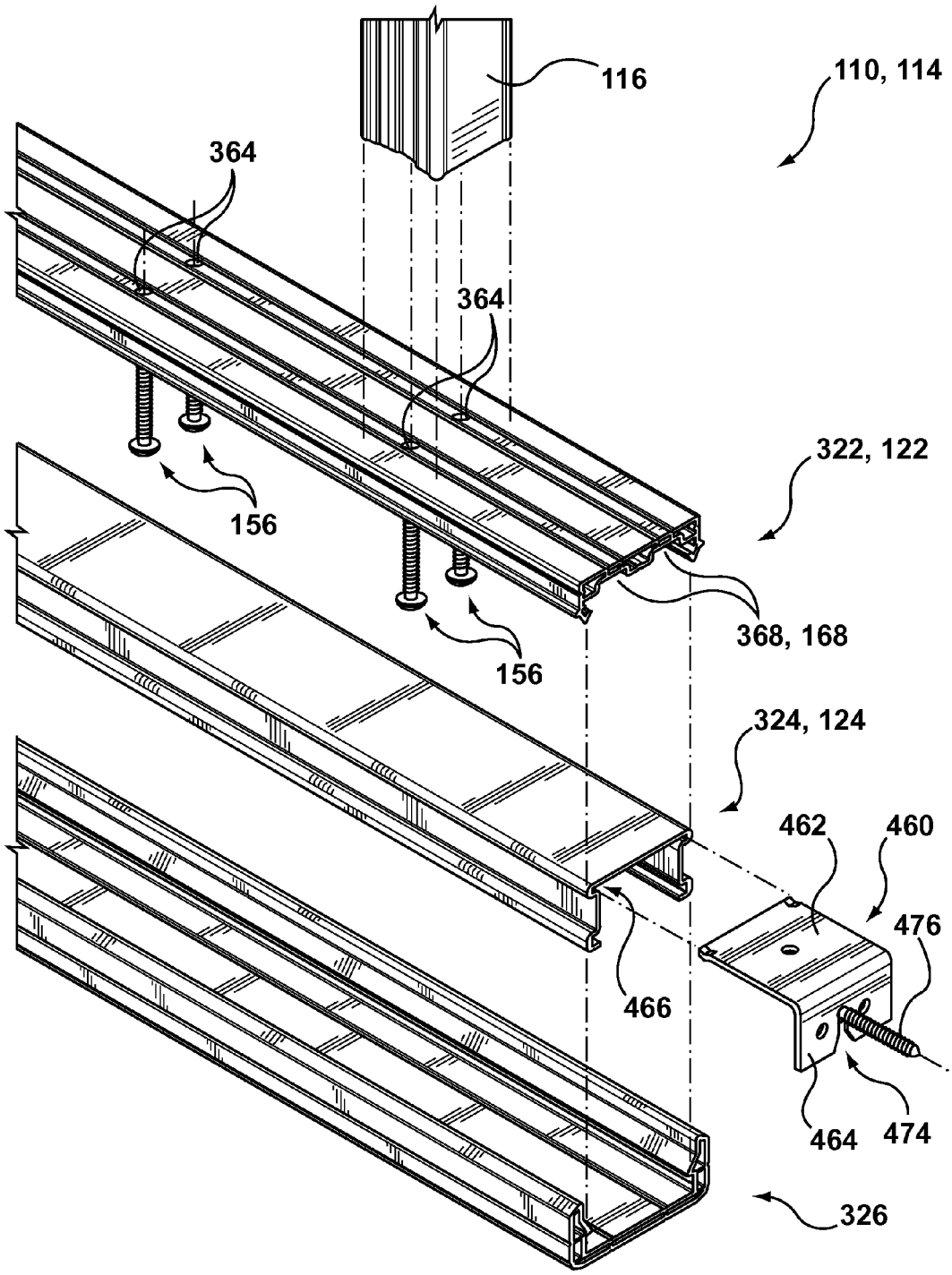
FIG. 6 is an exploded perspective view of an upper portion of the railing system of FIG. 2.

Further details of the lower rail 114 will now be described, with reference to FIGS. 5 and 6. The lower rail 114 can be of similar structure to that of the upper rail 112. In the example illustrated, like features of the lower rail 114 (compared to the upper rail 112) are identified by like reference characters, incremented by 200.

The lower rail 114 comprises a proximal member 322, a reinforcement member 324, and a cover member 326, each extending generally along the length of the lower rail 114. In the example illustrated, the cover member 326 is disposed in generally facing relation to the proximal member 322, and the reinforcing member 324 is disposed between the proximal and cover members 322, 326. As for the upper rail 114, the members 322, 324, and 326 of the lower rail can be secured together by a first and a second connection means. The first connection means can couple together the reinforcing member 324 with a first one of the proximal or cover members 322, 326. The second connection means can couple together the other (second) one of proximal or cover members 322, 326 with either the first one of the proximal or cover members 322, 326 or with the reinforcement member 324 or with both.

In the example illustrated, the first connection means associated with the lower rail 114 is adapted to couple together the reinforcement member 324 with the proximal member 322, and the second connection means associated with the lower rail 114 is adapted to couple together the cover member 326 with the reinforcement member 324.

In the example illustrated, the reinforcement member 324 of the lower rail 114 is of identical construction to the reinforcement member 124 of the upper rail 112, and mounted to the lower rail 114 in a vertically inverted orientation relative to the reinforcement member 124 of the upper rail 112. The reinforcement member 324 thus includes first attachment elements 330 comprising a pair of first lugs 342, and second attachment elements 332 comprising a pair of second lugs 344, each corresponding identically to the features 130,142 and 132,144 of the upper rail 112.

The proximal member 322 of the lower rail 114 can have similar structure as the proximal member 122 of the upper rail 112. In the example illustrated, the proximal member 322 of the lower rail 114 and the proximal member 122 of the upper rail 112 are of identical profile in cross-section, and can be cut from lineals extruded through the same die. The proximal member 322 of the lower rail 114 in the example illustrated accordingly comprises a base 350 having outer and inner surfaces 352, 354, each of which correspond identically to the base 150 and outer and inner surfaces 152, 154 thereof. The proximal member 322 is, in the illustrated example of a railing system 110, mounted in a vertically inverted orientation relative to the proximal member 112, with the outer surface 352 of the proximal member 322 bearing against the lower ends of the balusters 116 at mounting locations where the balusters 116 meet the lower rail 114.

Referring again to FIGS. 5 and 6, the cover member 326 is, in the example illustrated, secured over the reinforcing member 324, in a vertically inverted orientation relative to the proximal member 322. The cover member 326 can be similar in structure to the cover member 126 of the upper rail, and can be, but need not be, identical to the cover member 126. In the example illustrated, the cover member 326 of the lower rail 114 comprises generally the same features as the cover member 126 of the upper rail, with some distinctions as set out below. Like reference characters of the cover member 326 in comparison to the cover member 126 are identified by like reference characters, incremented by 200.

In the example illustrated, the cover member 326 comprises a base 400 having an outer surface 402 directed away from the reinforcement member 324, and an inner surface 404 directed towards the reinforcement member 324. The outer surface 402 is, in the example illustrated, of a flatter profile than the corresponding outer surface 202 of the cover member 126 of the upper rail 112.

The cover member 326 further comprises a second coupling element 422 in the form of a pair of second arms 424 for inter-engaging with the second attachment element 332 of the reinforcement member 324. Each of the second arms 424, in the example illustrated, comprises a laterally inwardly directed second barb 426, each having an underside surface 428 spaced vertically apart from the inner surface 404 of the base 400, and configured to bear against a distal surface 430 of a respective one of the second lugs 344. The opposing underside surface 428 of the second barb 426 and inner surface 404 of the second base 400, and an inner surface 432 of the arm 424 disposed therebetween and laterally offset therefrom defines a second recess 434 for receiving a respective one of the second lugs 344 in the assembled lower rail 314.

To assemble the railing system 110, the opposing proximal members 122 and 322 of the respective upper and lower rails 112, 114 can be secured to the respective upper and lower ands of the balusters 116. In the example illustrated, this can be accomplished by positioning the ends of the balusters at the desired mounting locations along the proximal members 122, 322 (aligning the screw bosses 160 with the optional apertures 164, 364, if provided). The screws 156 can then be inserted through the respective bases 150, 350, and into the balusters 116, with the heads 162 of the screws 156 bearing against the inner surfaces 154, 354 of the respective bases 150, 350.

The reinforcing members 124, 324 can then, in the example illustrated, be coupled to the respective proximal members 122, 322, by aligning the reinforcing members with the proximal members end-to-end with the first lugs 130, 330 in registration with the respective first recesses 184, 384, and sliding the members 124, 324 into the members 122, 322 in telescoping fashion. Alternatively, the reinforcing members 124, 324 can be coupled with the respective proximal members 122, 322 by snap fit, aligning the members 122 and 124 in facing relation, and the members 322 and 324 in facing relation, with the respective first lugs 130, 330 adjacent the distal ends of the respective first arms 174, 374, and then pressing the lugs 130, 330 past the barbs 176, 376 and into the corresponding recesses 184, 384.

Next, in the illustrated embodiment, the reinforcing members 124, 324 can be secured to the uprights 118. The railing system 110 can include brackets 460 (FIGS. 4 and 6) provided at either end of each of the upper and lower rails 112,114 to facilitate securing the reinforcing members 124, 324 to the uprights 118. Each bracket 460 can include a first flange 462 and a second flange 464. The first flange 462 can be adapted to slide into a groove or keyway 466 formed by hollow interiors 468 of the opposing lugs 142, 342 (FIGS. 3 and 5). When inserted into the keyways 466, the brackets 460 are constrained from moving relative to the reinforcement members 124, 324 in any direction other than along the length of the members.

Figure 7:
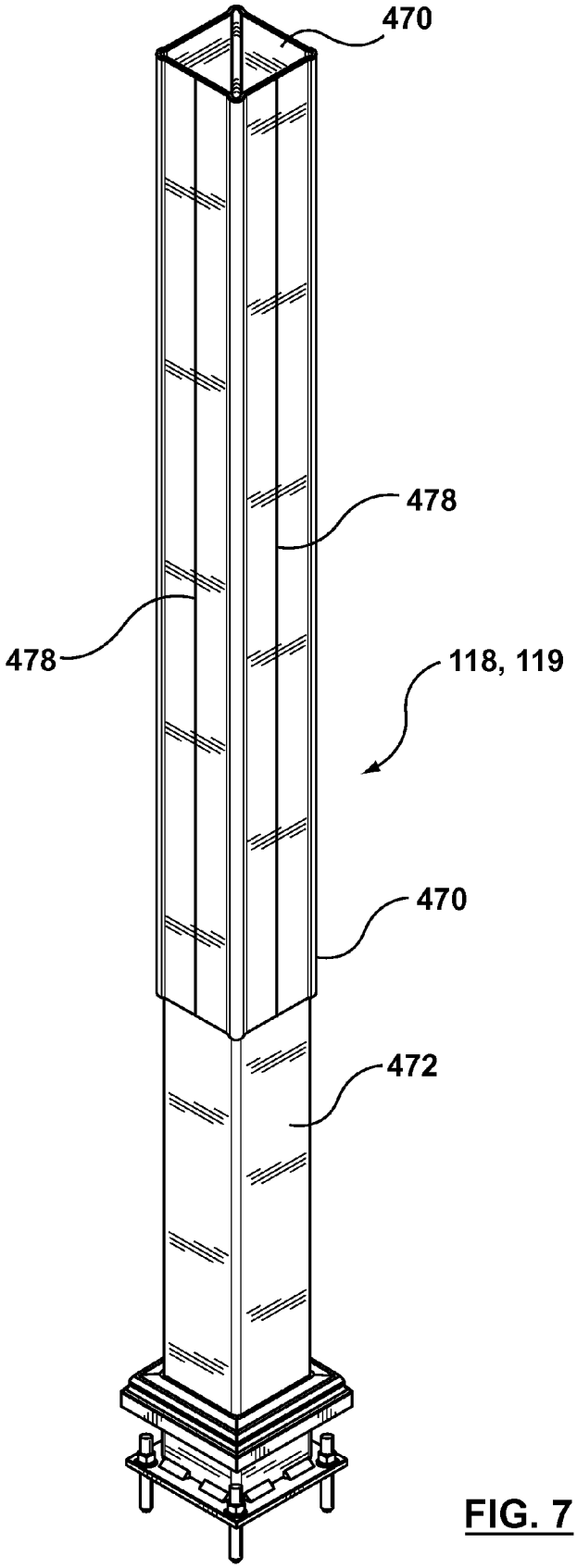
FIG. 7 is an enlarged perspective view of a newel post of the railing system of FIG. 2, shown partially dissasembled.

The second flange 464 is adapted to be secured to the uprights 118. Referring to FIG. 7, the uprights 118 can comprise newel posts 119 having an extruded vinyl tube or sleeve 470 installed over a central core 472 of steel or wood. The second flange 464 can include an aperture 474 therethrough, and can be secured to the newel post 119 by a fastener 476 extending through the aperture 474 in the second flange 464, through the sleeve 470 and into the core 472. The sleeve 470 can have integrally formed score lines 478 along one or more faces to indicate proper lateral positioning of the bracket 460 (and hence fastener 476) relative to the upright 118.

After the reinforcement members 124, 324 have been mounted to the uprights 118, the cover members 126, 326 can be installed over the reinforcement members 124, 324 of the respective upper and lower rails 112, 114. The cover members 126, 326 can be assembled by aligning each cover member 126, 326 between the uprights 118, with the second arms 224, 424 in vertical registration with the second lugs 144, 344 of the respective reinforcement member 124, 324. The cover member 126, 326 can then be pressed towards the reinforcement member 124, 324, urging apart the second arms 224, 424 and the lugs 144, 344 past the barbs 226, 426 and into the recesses 234, 434.

In the example illustrated, the first and second arms of the proximal and cover members of each rail are long enough (in a vertical direction) to generally abut or overlap, thereby generally concealing the reinforcement member 124, 324. The first arms are shorter than the second arms, in the example illustrated, and the first arms can be of single-walled construction to facilitate bending or pivoting of the first arms about the point of connection between the first arms and the base when urging the first lugs past the first barbs 176, 376.

In some examples, the members 322, 324, and 326 of the lower rail 114 can each be different than the corresponding members 122, 124, and 126 of the upper rail. In some examples, the members 322, 324, 326 of the lower rail 114 can each be identical to the corresponding members 122, 124, 126 of the upper rail 112. In some examples, the proximal members 122, 322 of the upper and lower rails 112, 114 can be identical to the cover members 126, 326 of the upper and lower rails, respectively.

Figure 8:
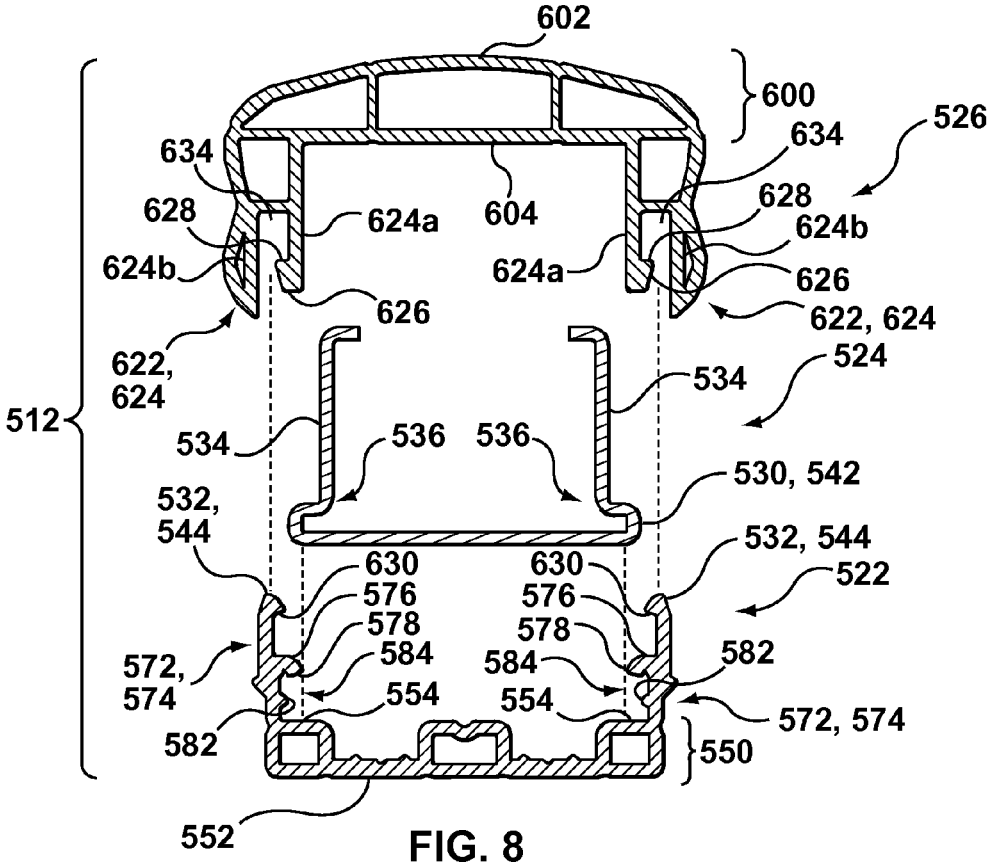
FIG. 8 is an exploded cross-sectional view of an alternative example of an upper or lower rail.
Figure 9:
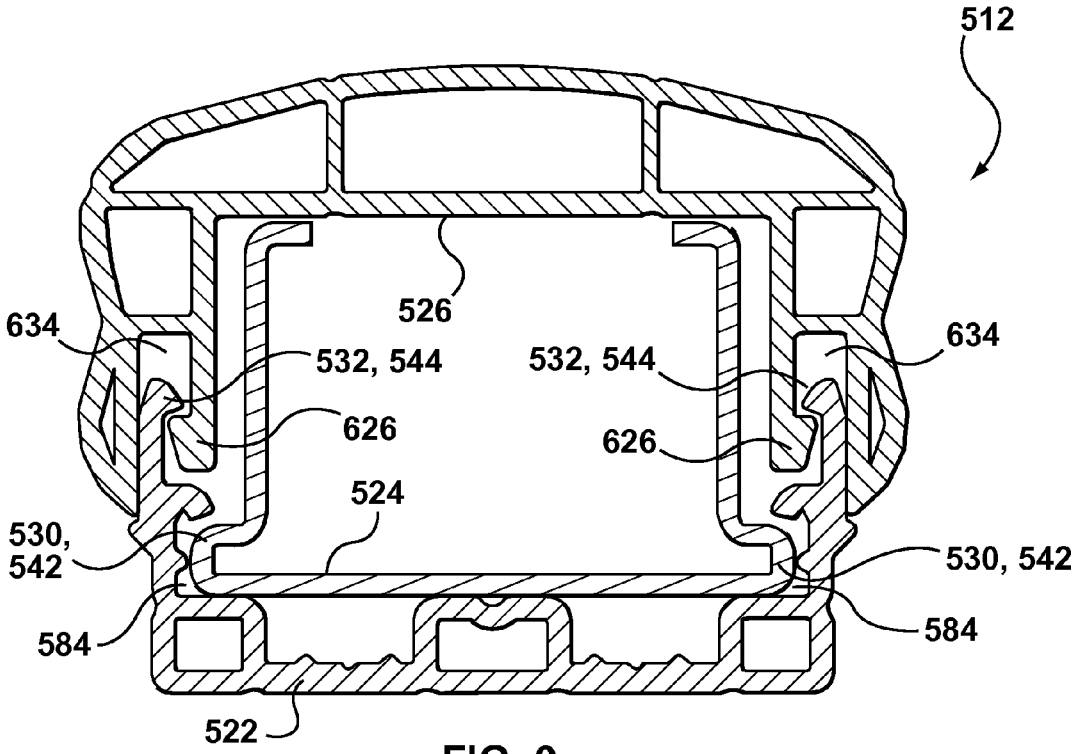
FIG. 9 is a cross-sectional view of the upper rail of FIG. 8 shown in the assembled state.

Referring now to FIGS. 8 and 9, an alternative example of a rail is illustrated. The rail of FIGS. 8 and 9 is identified at reference character 512, and for clarity is described for use as an upper rail 512, although use of the rail 512 or elements thereof as a lower rail is also comprehended by the applicant's teaching. The upper rail 512 is similar to the upper rail 112, and like features are identified by like reference characters, incremented by 400.

The upper rail 512 comprises a proximal member 522, a reinforcement member 524, and a cover member 526, each extending generally along the length of the upper rail 512. First and second connection means are provided for coupling together the members 522, 524, and 526. In the example illustrated, the first connection means is adapted to couple together the reinforcing member 524 with the proximal member 522, and the second connection means is adapted to couple together the cover member 526 with the proximal member 522.

The first connection means associated with the upper rail 512 is similar to that of the upper rail 112. The reinforcement member 524 is, in the example illustrated, provided with first attachment elements 530 for securing together the reinforcement member 524 and the proximal member 522. The first attachment elements 530 can comprise a pair of first lugs 542, each of the first lugs 542 projecting laterally outwardly from a respective sidewall 534 of the reinforcement member 524, and adjacent the proximal edge 536 thereof.

The proximal member 522 can comprise a first coupling element 572 for inter-engaging with the first attachment element 530 of the reinforcement member 524. In the example illustrated, the first coupling element 572 comprises a pair of first arms 574, the first arms 574 spaced laterally apart from each other to receive the first lugs 542 between the first arms 574. Each of the first arms 574 is, in the example illustrated, directed generally vertically towards the reinforcement member 524, and comprises a laterally inwardly directed barb 576. The opposing underside surface 578 of each barb 576 and inner surface 554 of the base 550, and an inner surface 582 of the arm 574 disposed therebetween and laterally offset therefrom define a recess 584 for receiving a respective one of the lugs 542 in the assembled rail 512.

In the example illustrated, the second connection means associated with the upper rail 512 is different in some respects than that of the upper rail 122. Rather than providing second attachment elements on the reinforcement member, the proximal member 522 comprises the second attachment elements 532, the second attachment elements adapted to secure together the proximal member 522 and the cover member 526. In the example illustrated, the second attachment element 532 comprises a pair of catches 544, each of the catches 544 projecting laterally inwardly from a respective one of the first arms 574, and adjacent a distal edge thereof.

In the upper rail 512, the cover member 526 comprises a second coupling element 622 for inter-engaging with the second attachment element 532 of the proximal member 522. In the example illustrated, the second coupling element 622 comprises a pair of second arms 624, the second arms 624 extending vertically towards the proximal member 522 and being of dual walled construction, having laterally inner and outer walls 624*a*, 624*b* respectively. The inner walls 624*a* are, in the example illustrated, spaced laterally apart from each other to receive the sidewalls 534 of the reinforcement member 524 therebetween. The outer walls 624*b* are spaced laterally apart from the adjacent inner walls 624*a* to receive the arms 544 of the proximal member 522 therebetween.

Each of the inner walls 624*a* of the arms 624 of the second coupling element 622 is, in the example illustrated, directed generally vertically towards the reinforcement member 524, and comprises a laterally outwardly directed second barb 626 (i.e. directed towards but spaced apart from, the adjacent outer walls 624*b* in the example illustrated). Each second barb 626 has an underside surface 628 spaced vertically apart from the inner surface 604 of the base 600, and configured to bear against a distal surface 630 of a respective one of the catches 544. An area between the inner and outer walls 624*a*, 624*b* of each arm 624 and behind the underside surface 628 of each second barb 626 defines a second recess 634 for receiving a respective one of the catches 544 in the assembled upper rail 512 (FIG. 9).

Figure 10:
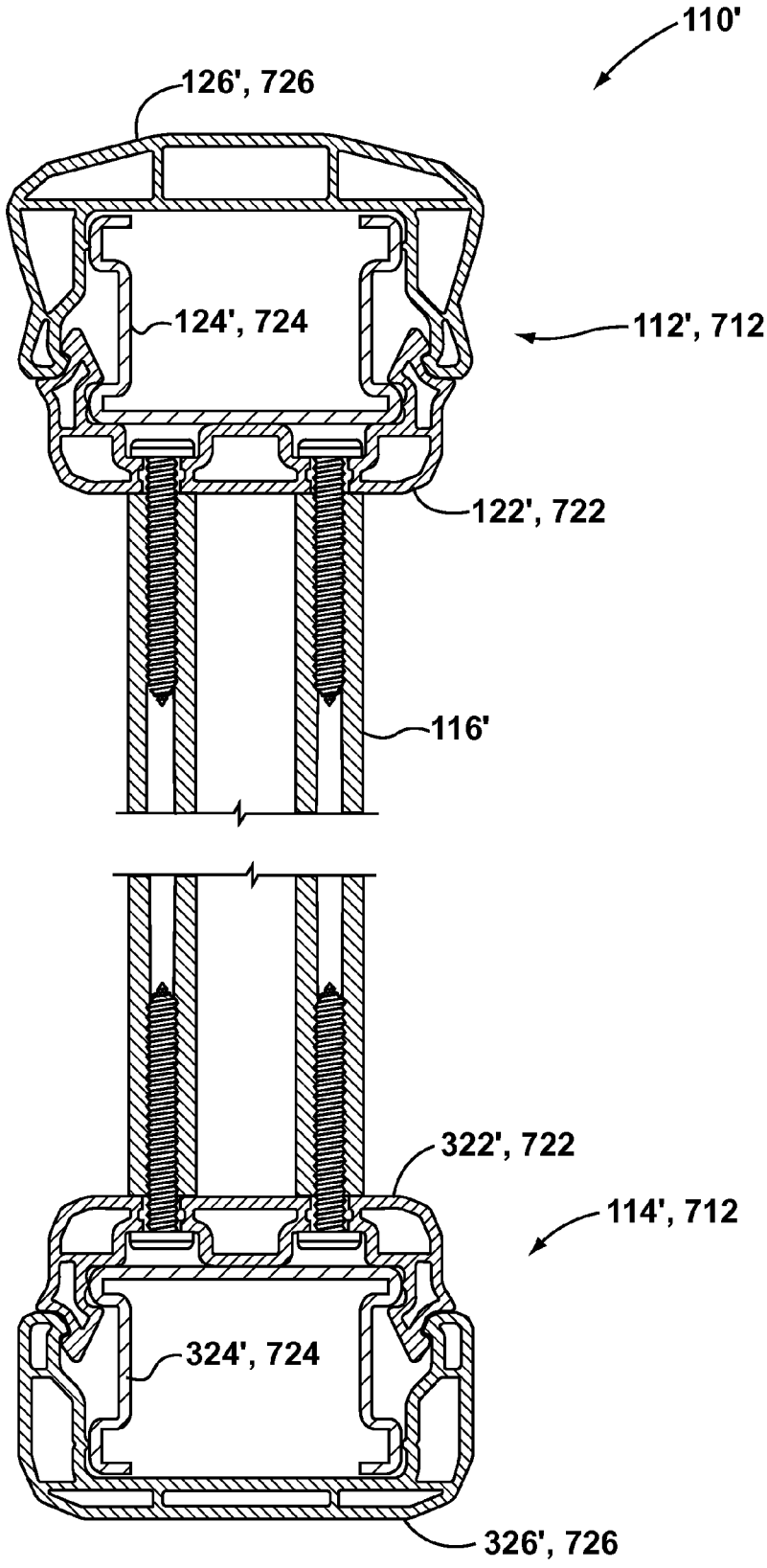
FIG. 10 is a cross-sectional view of an alternative example of a railing system according to the Applicant'ss teaching.

Referring now to FIG. 10, another example of a railing system 110' is shown, comprising an upper rail 112', a lower rail 114', and balusters 116' extending between the upper and lower rails 112', 114'. These elements are similar to the upper rail 112, lower rail 114, and balusters 116 of the railing system 110, and like features are referred to with like reference characters, with a prime suffix. There are some differences as will be understood with reference to the following description.

The upper and lower rails 112', 114' are referred to generically as rail 712. For simplicity, like features of the rail 712 are identified herein with like reference characters of corresponding elements of the upper rail 112, incremented by 600.

Figure 11:
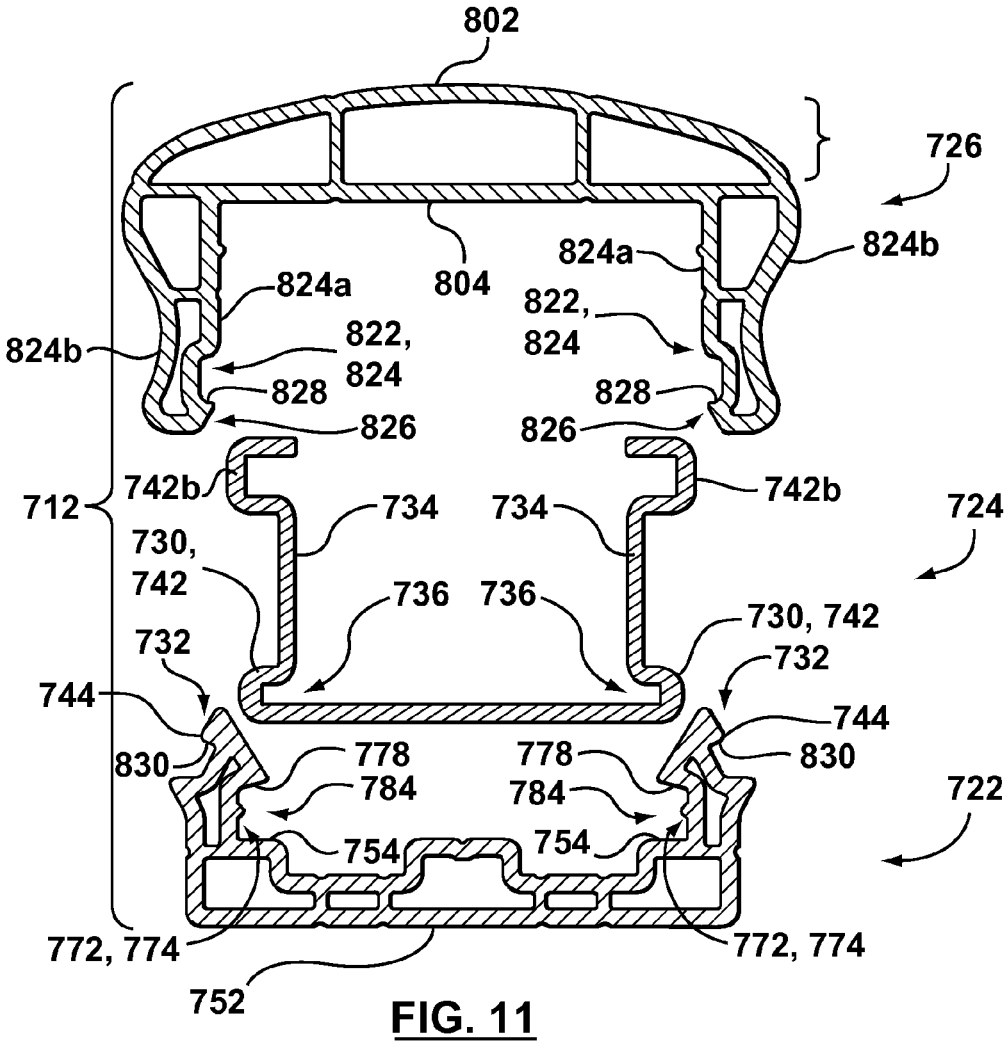
FIG. 11 is an exploded cross-sectional view of the upper rail of the railing system of FIG. 10.
Figure 12:
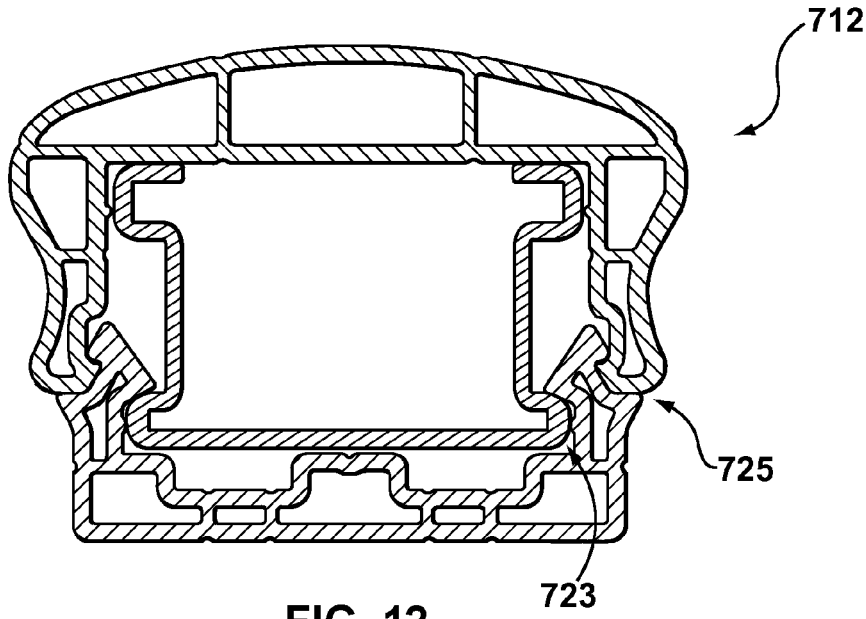
FIG. 12 is an enlarged cross-sectional view of the upper rail of the railing system of FIG. 10 shown in the assembled state.

As seen more clearly in FIGS. 11 and 12, the rail 712 comprises a proximal member 722, a reinforcement member 724, and a cover member 726, each extending generally along the length of the rail 712. First and second connections means 723, 725 are provided for coupling together the members 722, 724, and 726. In the example illustrated, the first connection means 723 is adapted to couple together the reinforcing member 724 with the proximal member 722, and the second connection means 725 is adapted to couple together the cover member 726 with the proximal member 722.

The first connection means 723 associated with the rail 712 is similar to that of the upper rail 112. The reinforcement member 724 is, in the example illustrated, provided with first attachment elements 730 for securing together the reinforcement member 524 and the proximal member 722. The first attachment elements 730 can comprise a pair of first lugs 742, each of the first lugs 742 projecting laterally outwardly from a respective sidewall 734 of the reinforcement member 724, and adjacent the proximal edge 736 thereof.

The proximal member 722 can comprise a first coupling element 572 for inter-engaging with the first attachment element 530 of the reinforcement member 524. In the example illustrated, the first coupling element 572 comprises a pair of first arms 574, the first arms 574 spaced laterally apart from each other to receive the first lugs 542 between the first arms 574. Each of the first arms 774 is, in the example illustrated, directed generally vertically towards the reinforcement member 724, and comprises a laterally inwardly directed barb 776. Each barb 776 has an underside surface 578 spaced apart from and facing towards the inner surface 554 of the base 550. The opposing underside surface 578 and inner surface 554, along with an inner surface 582 of the arm 574 disposed therebetween and laterally offset therefrom, define a recess 584 for receiving a respective one of the lugs 542 in the assembled rail 512.

In the example illustrated, the second connection means associated with the rail 712 comprises second attachment elements 732 and a second coupling element 822. The proximal member 722 comprises the second attachment elements 732, the second attachment elements 732 adapted to secure together the proximal member 722 and the cover member 726. In the example illustrated, the second attachment element 732 comprises a pair of catches 744, each of the catches 744 projecting laterally outwardly from a respective one of the first arms 774, and adjacent a distal edge thereof.

The cover member 726 comprises the second coupling element 822 for inter-engaging with the second attachment element 732 of the proximal member 722. In the example illustrated, the second coupling element 822 comprises a pair of second arms 824 that extend from the inner surface 804 of the base 800 of the cover member 726. The second arms 824 can be of dual walled construction, having laterally inner and outer walls 824*a*, 824*b*. The inner walls 824*a* are, in the example illustrated, spaced laterally apart from each other to receive the sidewalls 734 of the reinforcement member 524 (with optional outwardly protruding second lugs 742*b*).

Each of the inner walls 642*a* of the arms 624 of the second coupling element 622 is, in the example illustrated, directed generally vertically towards the reinforcement member 724, and comprises a laterally inwardly directed second barb 826. Each second barb 826 has an underside surface 828 generally facing the inner surface 804 of the base 800, and configured to bear against a corresponding underside (or distal) surface 830 of a respective one of the catches 744.

While the above description provides examples of one or more processes or apparatuses, it will be appreciated that other processes or apparatuses may be within the scope of the accompanying claims.

The invention claimed is:

1. A railing system, comprising:

a) a plurality of balusters each baluster having an upper end and a lower end b) an upper rail mounted to the upper ends of the balusters;

c) the upper rail comprising a proximal member secured to the upper ends of the balusters, a reinforcement member for mounting each end of the rail to a post, the reinforcement member having a first attachment element coupled to the proximal member, and a cover member coupled to at least one of the reinforcement member and the proximal member enclosing the reinforcement member between the proximal member and the cover;

d) fasteners each having a threaded shank and a head at one end thereof, the head bearing against the proximal member opposite the balusters, and the threaded shank extending through the proximal member and into the balusters: and wherein each head is disposed between the reinforcement member and the proximal member; and e) a newel post supporting an end of the reinforcement member, the railing system further comprising a bracket having a first flange securable to the reinforcement member and a second flange securable to the newel post, wherein the newel post comprises an extruded body having an outer surface supporting the second flange of the bracket, the bracket having an aperture for receiving a fastener therethrough, and the outer surface of the newel post comprising an integrally molded score line aligned with the aperture of the bracket for laterally positioning the bracket on the post.

2. A rail for a railing system, comprising:

a) a proximal member secured to a plurality of balusters, the proximal member comprising a first coupling member and a second coupling member each extending lengthwise of the proximal member and integrally formed therewith;

b) a reinforcement member for mounting each end of the rail to a post, the reinfoecement member having a first attachment element interengageable with the first coupling member; and c) a cover member having a second attachment element interengageable with the second coupling member enclosing the reinforcement member between the proximal member and the cover;

wherein the reinforcement member is generally channel shaped, having two sidewalls and a transverse wall extending between the two sidewalls and the first attachment element comprises a pair of first lugs, each one of the first lugs protruding laterally outwardly from a respective sidewall adjacent the transverse wall, and wherein the first coupling member comprises a pair of laterally spaced apart arms extending generally upright from a base of the proximal member, each arm having a recess for receiving a respective one of the lugs and the transverse wall of the reinforcement member is spaced apart from an upper surface of at least a portion of the base when the lugs are received in the recesses, wherein a plurality of screws are provided for securing the proximal member to said balusters, each screw having a shank extending through the proximal member and into one of said balusters and a head at one end of the shank, and wherein the heads of the screws are accommodated between the proximal member and the reinforcement member.

3. A railing system, comprising:

a) a plurality of balusters, each baluster having an upper end and a lower end;

b) an upper rail mounted to the upper ends of the balusters;

c) the upper rail comprising a proximal member constructed of a first extruded lineal and secured to the upper ends of the balusters, a reinforcement member for mounting each end of the rail to a post, the reinforcement member having laterally spaced apart first attachment elements coupled to the proximal member, and a cover member constructed of a second extruded lineal and coupled to at least one of the reinforcement member and the proximal member enclosed the reinforcement member between the proximal member and the cover; and d) a plurality of fasteners each having a threaded shank and a head at one end thereof, the head bearing against the proximal member opposite the balusters, and the threaded shank extending through the proximal member and into the balusters without engaging or passing through the reinforcement member, wherein the reinforcement member includes a transverse wall extending between the spaced apart first attachment elements, and wherein each head is disposed between the transverse wall of the reinforcement member and an upper surface of the proximal member.

4. The railing system of claim 3, wherein the first attachment element and the reinforcement member are of integral, unitary construction.

5. The railing system of claim 4, wherein the first attachment element comprises a pair of first lugs, each first lug protruding laterally outwardly of the reinforcement member.

6. The railing system of claim 3, wherein the proximal member comprises a first coupling element for engaging the first attachment element, the first coupling element being of unitary, integrally extruded construction with the first lineal.

7. The railing system of claim 6, wherein the first coupling element comprises a pair of first arms, each first arm including a laterally inwardly directed barb.

8. The railing system of claim 7, wherein each first arm and barb extend generally continuously along the length of the proximal member.

9. The railing system of claim 8, wherein the proximal member comprises a second attachment element, and the cover member comprises a second coupling element for engaging the second attachment element.

10. The railing system of claim 9, wherein the second attachment element is of unitary, integrally extruded construction with the first lineal.

11. The rail of claim 10, wherein the second attachment element comprises a pair of catches, each catch projecting laterally outwardly from a respective one of a pair of first arms of the proximal member.

12. The railing system of claim 11, wherein the second coupling element comprises a pair of second arms spaced apart to straddle the proximal member, each of the second arms including a laterally inwardly directed second barb for interengaging a respective one of the catches.

13. The railing system of claim 10, wherein the second coupling element is of unitary, integrally extruded construction with the second lineal.

14. The railing system of claim 6, wherein the cover member is coupled to the proximal member.

* * * * *